United States Patent [19]

Liu

[11] Patent Number: 4,625,879

[45] Date of Patent: Dec. 2, 1986

[54] USER ASSEMBLED DESK TOP FILE

[76] Inventor: Clark W. Liu, 9 Deerpath Dr., Vernon Hills, Ill. 60061

[21] Appl. No.: 793,248

[22] Filed: Oct. 31, 1985

[51] Int. Cl.[4] ..... B65D 6/00; B65D 6/12; B65D 6/16

[52] U.S. Cl. ..... 220/4 R

[58] Field of Search ..... 220/4 R, 4 F; 206/577, 206/467, 468

[56] References Cited

U.S. PATENT DOCUMENTS 3,366,274 1/1968 Hinrichs ..... 220/4 R
4,305,504 12/1981 Bredal ..... 220/4 R

*Primary Examiner*—George T. Hall

[57] ABSTRACT

An all-plastic desk top vertical file or stand easily user assembled from planar panels that lock together with either snap-in integral barb or lateral tongue and slot connections without the use of any tools.

11 Claims, 32 Drawing Figures

USER ASSEMBLED DESK TOP FILE

BACKGROUND OF THE INVENTION

One-piece plastic desk or table top vertical files have achieved a significant amount of commercial success in the last several years because of their relatively low cost, space saving advantages and ease of use. One such product takes the form of a phone book stand that has top, bottom, rear and side walls. The side walls along with several partition walls are vertically arranged and scalloped to expose identification material on the phone books. Another similar product takes the form of a magazine file that is similar to the phone book stand except that it does not include the partition walls. This file holds a plurality of magazines in vertical orientation and still permits viewing a part of the magazine covers without removing them completely from the file. Still another one of these vertical files takes the form of a "handy file" that is essentially a cubicle container without a top wall that receives standard vertical dividers to define a paperwork type file.

All of these prior files are one-piece plastic moldings frequently as large as 12"×12"×12". These files or stands are injection moldings and because of their size require a very large mold and an injection molding machine large enough to inject the full volume of resin to complete the entire product. Such tooling is extremely costly because of its size and many small to medium size injection molding machines cannot be used to manufacture this product.

While these one-piece prior plastic files are relatively inexpensive, their product shipping containers are very large and therefore the shipping cost per part is inordinately high for a product in this low price category. A still further problem is that, as in all plastic parts, there are molding defects that result from shrinkage, inadequate injection pressure and other causes that produce part rejects, and since these products are made in one piece, a defect in part of the product requires that the entire product be rejected, further increasing product cost.

All of these characteristics of prior desk top plastic vertical files or stands contribute to the cost of the product and it is a primary objective of the present invention to ameliorate these cost-producing features without sacrificing any product utility.

SUMMARY OF THE PRESENT INVENTION

According to the present invention an all-plastic desk top vertical file or stand is provided that is easily user assembled from planar panels that lock together with either snap-in integral barb connectors or lateral tongue and slot connectors, both without the use of any tools. The file or stand is packaged and sold with the planar panels disassembled and stacked to minimize the size of the shipping container. Each of the planar panels is separately molded and because of their planar configuration, the overall mold cost for all the individual panel molds is far less than the mold cost for a single one-piece mold because of its large size requirement.

Toward these ends, and according to the exemplary embodiment of the product illustrated in this application, which is a phone book vertical stand, the stand includes a bottom panel, a shortened top panel, a rear panel and scalloped vertical side panels and partitions that expose part of the phone book to facilitate book retrieval. The top and bottom panels have L-shaped slots that slidably receive the side panels and the partition panels, both of which have lateral tongues that slide in the slots and lock the side and partition panels thereto. The top and bottom panels also have a plurality of sets of dual flexible barbs on one end thereof that snap into rectangular openings along the top and bottom of the rear panel. These barbs each have shoulders that stabilize the top and bottom panels on the rear panel as well as tongues that fit in narrow slots in the rear panel to provide additional stabilization.

Another important feature in the present invention is that the L-shaped slots in the top and bottom panels are formed in the mold without any movable core elements by forming part of the slot in the mold top plate and another part of the slot in the mold bottom plate. Basically this is achieved by forming the tongue or lateral portion of the slot in the bottom plate and the other portion of the slot in the mold top plate, except for spaced bridge portions that maintain panel rigidity.

Other objects and features of the present invention will become apparent from the detailed description of the invention.

It should be understood, however, that the principles of the present invention can also be applied to the magazine file and the "handy file" described above.

DETAILED DESCRIPTION OF THE PREFERRED EMBODIMENT

Figure 1:
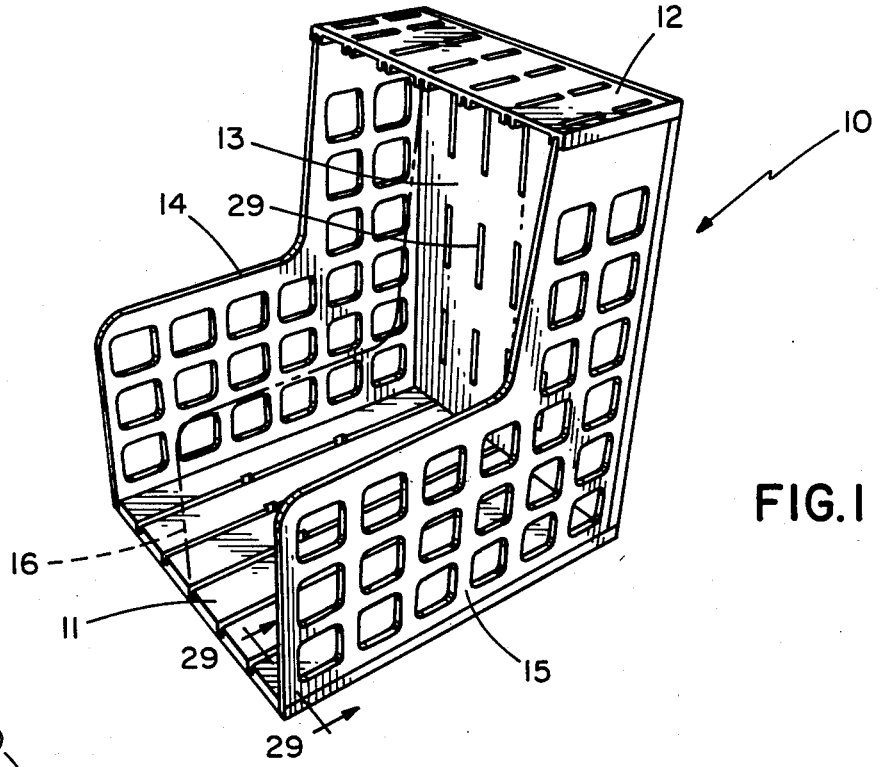
FIG. 1 is a perspective view of a vertical stand for telephone books according to the present invention.
Figure 4:
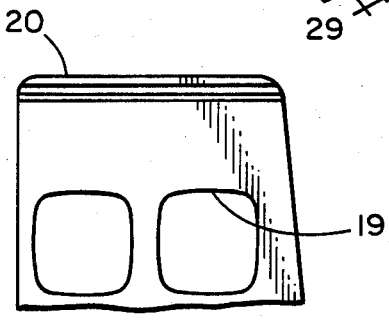
FIG. 4 is a fragmentary rear view of the upper portion of the side panel illustrated in FIG. 2.
Figure 2:
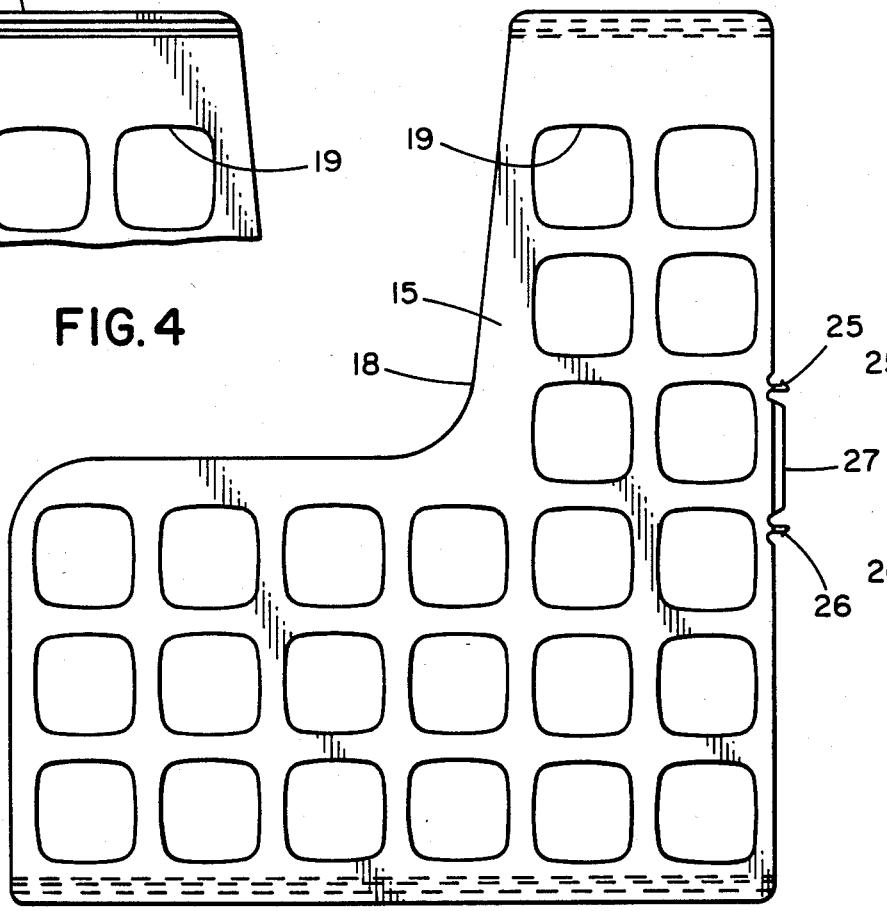
FIG. 2 is an enlarged sub-assembly of one of the side panels illustrated in FIG. 1.
Figure 3:
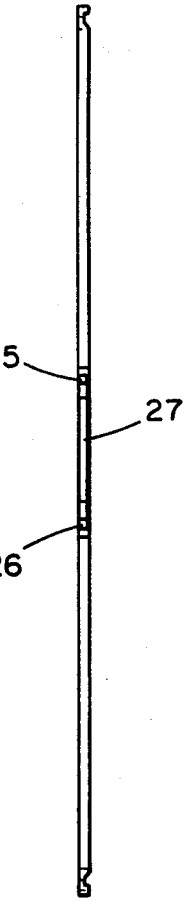
FIG. 3 is a right-side view of the side panel illustrated in FIG. 2.
Figure 5:
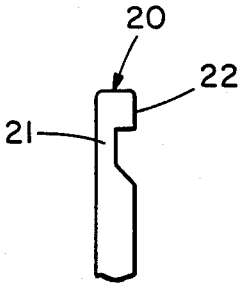
FIG. 5 is an enlarged right upper side fragmentary view of the side panel illustrated in FIGS. 2 to 4.
Figure 6:
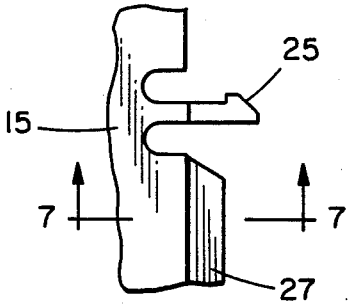
FIG. 6 is an enlarged fragmentary view of the rear panel connector on the side panel illustrated in FIGS. 2 and 3.
Figure 7:
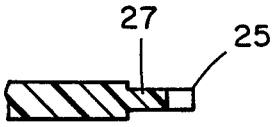
FIG. 7 is a fragmentary section taken generally along line 7—7 of FIG. 6.

Referring to the drawings and particularly FIG. 1, a vertical stand 10 is illustrated, particularly adapted to hold telephone books in a vertical position to conserve space and permit easier retrieval. The approximate dimensions of stand 10 are horizontally 10″×10″ and vertically 14″. Stand 10 is seen to include bottom panel 11, top panel 12, side panels 14 and 15 and partition panels 16 that are identical in configuration to the side panels 14 and 15. Thus a single mold can be utilized to make both the side panels 14 and 15 and the partition panel 16. Although one partition panel 16 is illustrated in FIG. 1 any number equal to or lesser than the number of slots in the bottom and top panels 11 and 12 may be provided depending upon the size of the books desired to be accommodated. The partition panel 16 may advantageously be selectively positioned in any of the slots in the bottom and top panels 11 and 12 to accommodate the specific width books of the user, thus he has some opportunity to customize the stand to his needs.

Side panel 15 is illustrated in FIGS. 2 through 7 and is seen to include a cut out portion 18 to facilitate book removal and viewing, and it has a plurality of generally rectangular apertures 19 to improve product aesthetics and to conserve material and product weight. Both the top and bottom edges of panel 15 have a tongue 20 illustrated more clearly in FIGS. 5 and 29. Tongue 20 is generally L-shaped in configuration and includes a first narrow leg portion 21 and a laterally extending slide projection or tongue portion 22.

Figure 21:
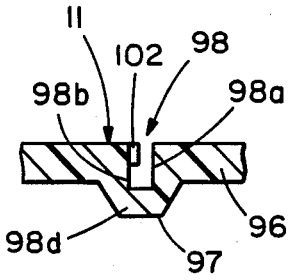
FIG. 21 is a fragmentary section of the slot in the bottom panel taken generally along line 21—21 in FIG. 18.
Figure 22:
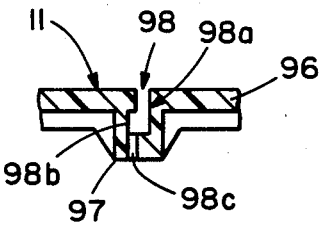
FIG. 22 is another fragmentary cross-section through the slot in the bottom panel taken generally along line 22—22 of FIG. 18.
Figure 29:
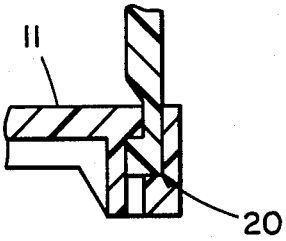
FIG. 29 is an enlraged fragmentary section taken generally along line 29—29 of FIG. 1 illustrating the lateral tongue and slot connection between one of the side panels and the bottom panel.

The tongues 20 on the top and bottom of the side panels 14 and 15 and the partition panels slide in L-shaped slots in the top and bottom panels 11 and 12 illustrated in FIGS. 21 and 22 and FIG. 29. This enables the side panels and partition panels to be assembled by sliding them into the slots, which also locks the side panels and partition panels to the top and bottom panels 11 and 12.

The right side of the partition and side panels as seen in FIGS. 2, 3, 6 and 7 are formed with approximately centrally positioned spaced barbs 25 and 26 that flank a generally planar tongue projection 27. The barbs 25 and 26 are somewhat flexible and spaced apart so that they snap into and lock in one of the middle slots 29 in the rear panel 13 illustrated in FIGS. 1 and 8. Tongue 27 also fits in the slots 29 and provides vertical stabilization for the side and partition panels on the rear panel 13.

As seen in FIGS. 8 to 11 the rear panel 13 is rectangular and planar in configuration and has a forward wall 31 with three rows of slots 32, 29 and 33 therein with rectangular apertures 35 at its four corners and square apertures 36 and 37 along its upper and lower edges flanked by elongated slots 38 and 39 respectively.

Figure 10:
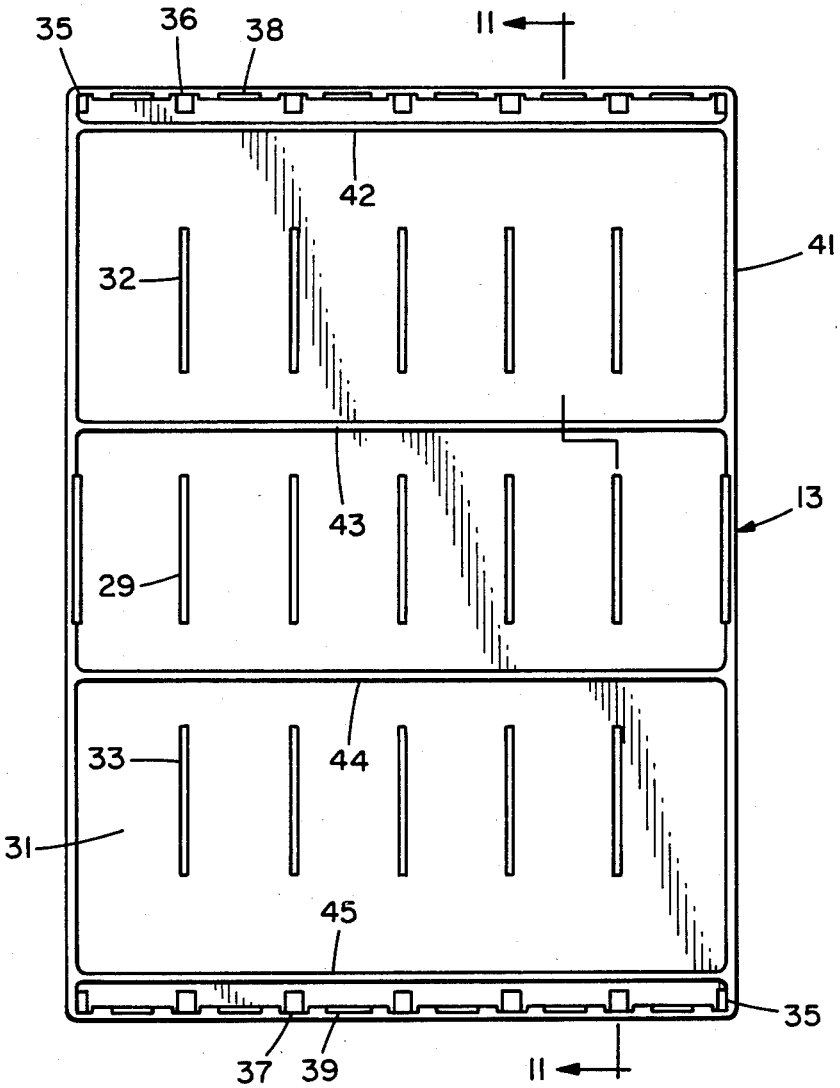
FIG. 10 is a rear view of the rear panel illustrated in FIGS. 8 and 9.
Figure 11:
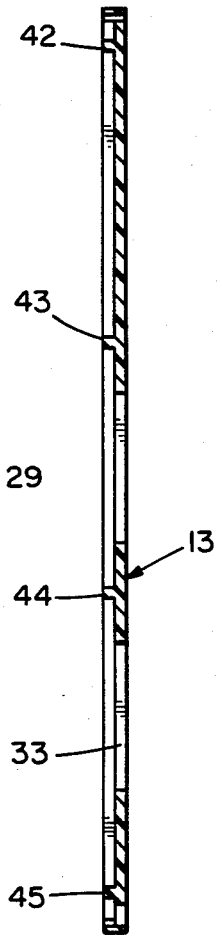
FIG. 11 is a longitudinal section of the rear panel taken generally along line 11—11 of FIG. 10.
Figure 12:
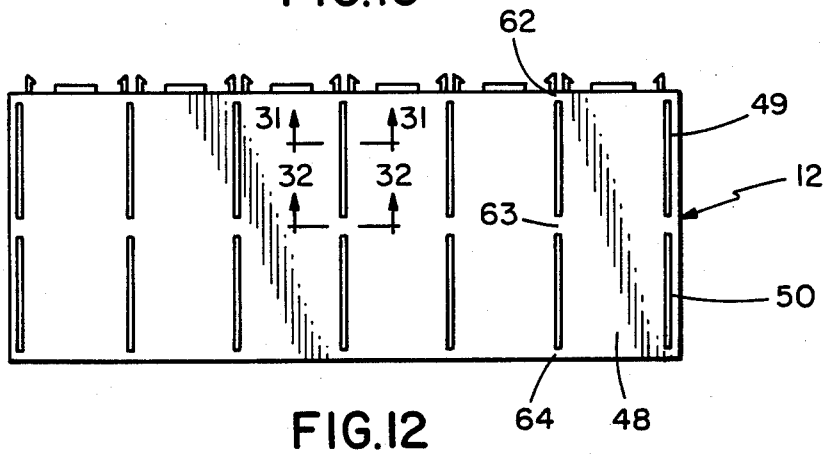
FIG. 12 is a front view of the top panel illustrated in FIG. 1.
Figure 13:
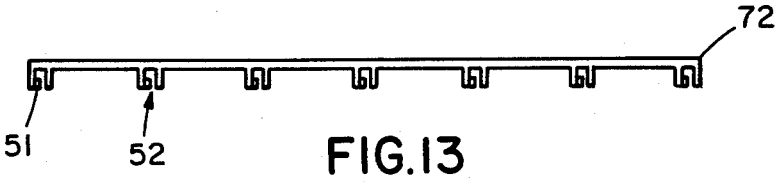
FIG. 13 is a bottom view of the top panel illustrated in FIG. 10.

As seen in FIG. 10 the rear wall 13 has a peripheral supporting rib 41 and transverse reinforcing ribs 42, 43, 44 and 45. As seen more clearly in FIG. 10 the slots 38 and 39 extend through a portion of the peripheral rib 41.

The top panel 12 is illustrated more clearly in FIGS. 12 to 17 and is seen to include a planar wall 48 having two rows of slots 49 and 50 therein on its forward surface (upper surface when viewed with respect to FIG. 1), and a plurality of ribs 51 on its rear surface (its lower surface as viewed in FIG. 1) that define seven parallel L-shaped slots 52 that slidably receive and lock the upper tongue connectors 20 on the side panels 14 and 15 and the partition panels.

As seen in FIGS. 13, 14, 15, 16 and 17, the slots 52 are formed by a first slot portion 53 that extends entirely across the top panel 12 and opens to the rear surface of the ribs 51 and a second slot portion 54 that also extends entirely across the panel 12 but is covered by rib portion 56 except at cut outs 58, 59 and 60. Cutouts 58, 59 and 60 are aligned over web portions 62, 63 and 64 that interrupt the slots 49 and 50. The web portions 62, 63 and 64 provide rigidity to the top panel 12.

The top panel 12 also includes a plurality of sets of barbs 80 in line with the ribs 52, each including spaced barbs 81 and 82, and single barbs 85 and 86 at the ends of the panel. Each of the barbs 81 and 82 includes a base portion 87 in line with one of the ribs 52 and a laterally projecting portion 88 having a forwardly converging tapered ramp portion 89. The barb portions 87 are flexible to permit the barbs when entering the rectangular apertures 36 in the rear panel 13 to flex toward one another as the tapered ramp portion 88 engages one of the forward edges of the aperture 36.

Figure 14:
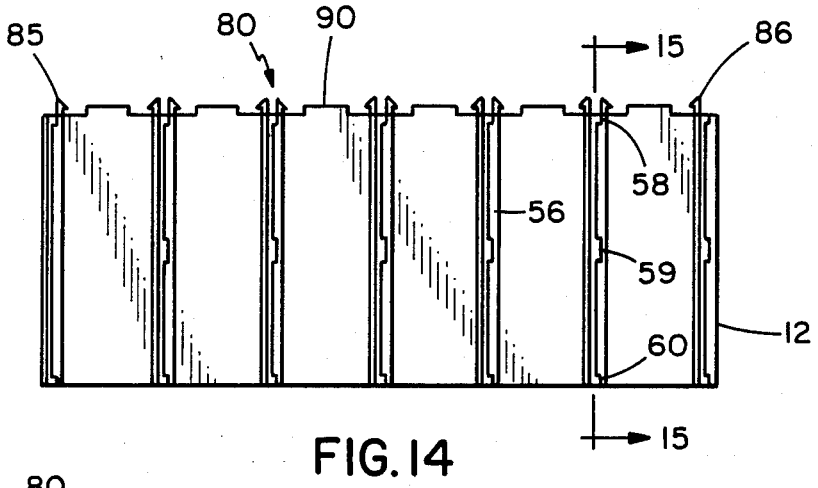
FIG. 14 is a rear view of the top panel illustrated in FIGS. 12 and 13.
Figure 15:
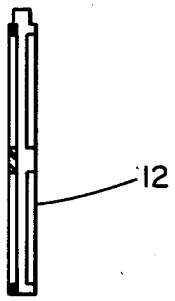
FIG. 15 is a longitudinal section through the top panel taken generally along line 15—15 of FIG. 14.
Figure 16:
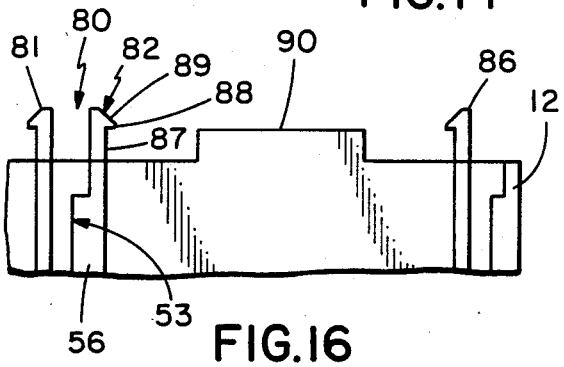
FIG. 16 is an enlarged fragmentary rear view of the top panel illustrated in FIG. 14 showing the barb connectors.
Figure 17:
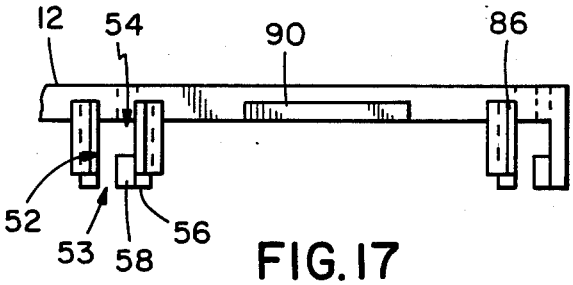
FIG. 17 is a fragmentary enlarged top view of the barbs on the top panel illustrated in FIG. 16.
Figure 18:
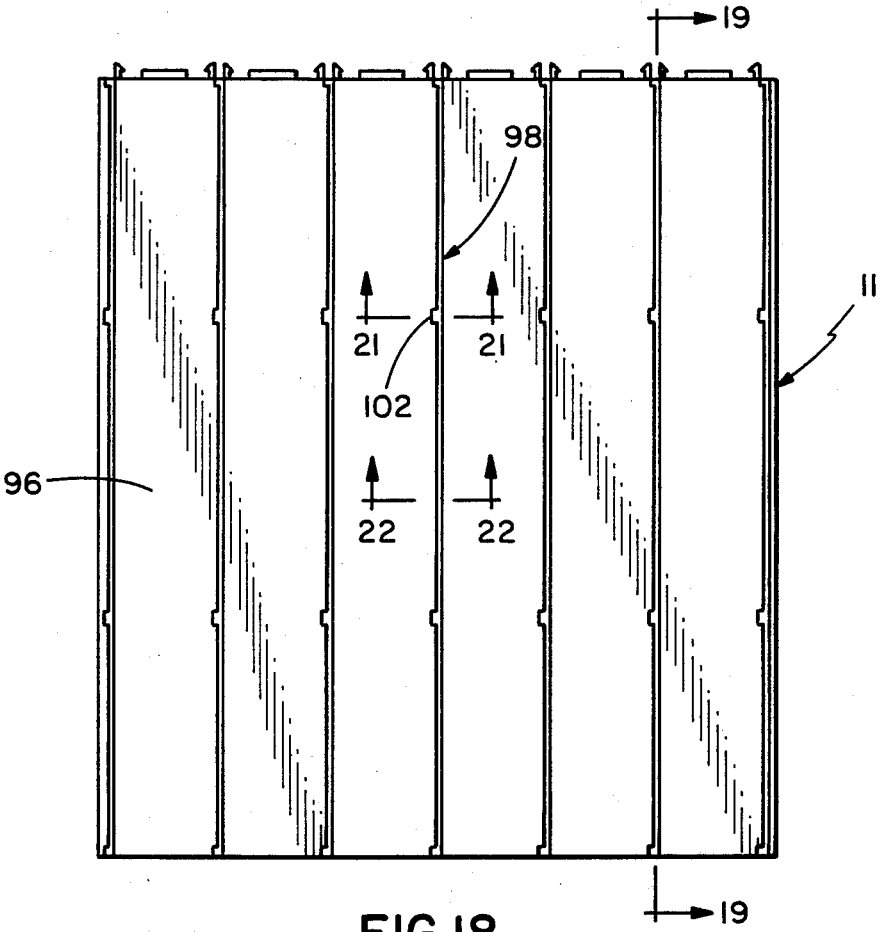
FIG. 18 is a front view of the bottom panel illustrated in FIG. 1.
Figure 19:
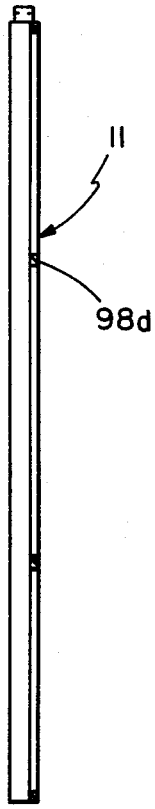
FIG. 19 is a longitudinal section through the top panel taken generally along line 19—19 of FIG. 18.
Figure 26:
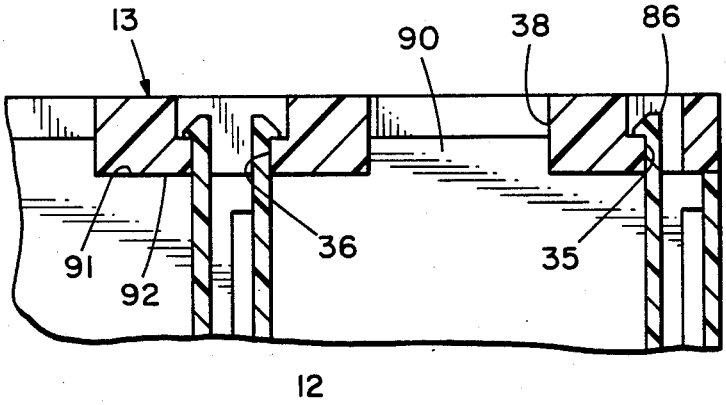
FIG. 26 is a cross-section illustrating the top panel barb sets locking to apertures in the rear panel taken generally along line 26—26 of FIG. 25.

Between each set of barbs 80 is a rectangular integral tongue portion 90 as seen clearly in FIGS. 14 and 26. The sets of barbs 80 are sized to snap into the recesses 36 and lock the panel 12 to the back panel 13 without play as seen clearly in FIG. 26 with shoulders 91 on the top panel 12 engaging the forward surface 92 of the rear panel 13 and with tongues 90 closely interfitted in slots 38 to provide further rigidity for the top panel 12 of the rear panel 13. Similarly, the end barbs 85 and 86 interfit in the stepped recesses 35 in the back panel 13, also as shown clearly in FIG. 26.

Figure 27:
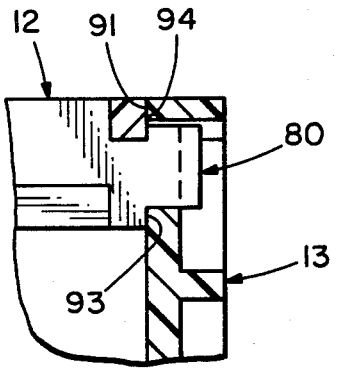
FIG. 27 is a fragmentary section taken generally along line 27—27 of FIG. 25 illustrating the shoulder barbs on the top panel engaging the front surface of the rear panel.
Figure 28:
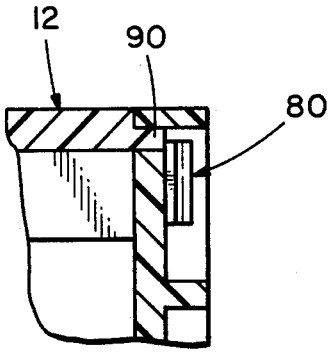
FIG. 28 is a fragmentary section taken generally along line 28—28 of FIG. 25 illustrating the tongue connector on the top panel extending into one of the slots in the rear panel.

As seen more clearly in FIG. 27 the top panel 12 has shoulders 93 and 94 on the vertically opposite sides of the barbs 80 as well as barbs 85 and 86 that engage the forward surface 91 of the rear panel 13 to provide vertical stability for the top panel 12 on the rear panel 13.

The bottom panel 11 is illustrated in FIGS. 18, 19, 20, 21, 22, 23 and 24 and is seen to be constructed in the same general manner as the top panel 12 with slots to accommodate the side panels 14, 15 and the partition panels 16 and barbs to lock itself to the rear panel 13 except that the direction of the slots are reversed with respect to forward and rear surfaces of the panel. Toward this end the panel 11 includes a planar wall 96 having a plurality of ribs 97 on its rear surface that define slots 98 that are identical in interior shape to the slots 52 in top panel 12. As seen in FIG. 21 and 22 slots 98 are defined by a through slot portion 98*a* and a lateral connecting slot portion 98*b*. Ribs 97 have segmented slots in their rear surface communicating with slot portion 98*b* separated by webs 98*d*. One end of the bottom panel 11 has a plurality of sets of barbs 99 identical to barbs 80 in the top panel and end barbs 100 and 101 identical to barbs 85 and 86 in the top panel.

Figure 30:
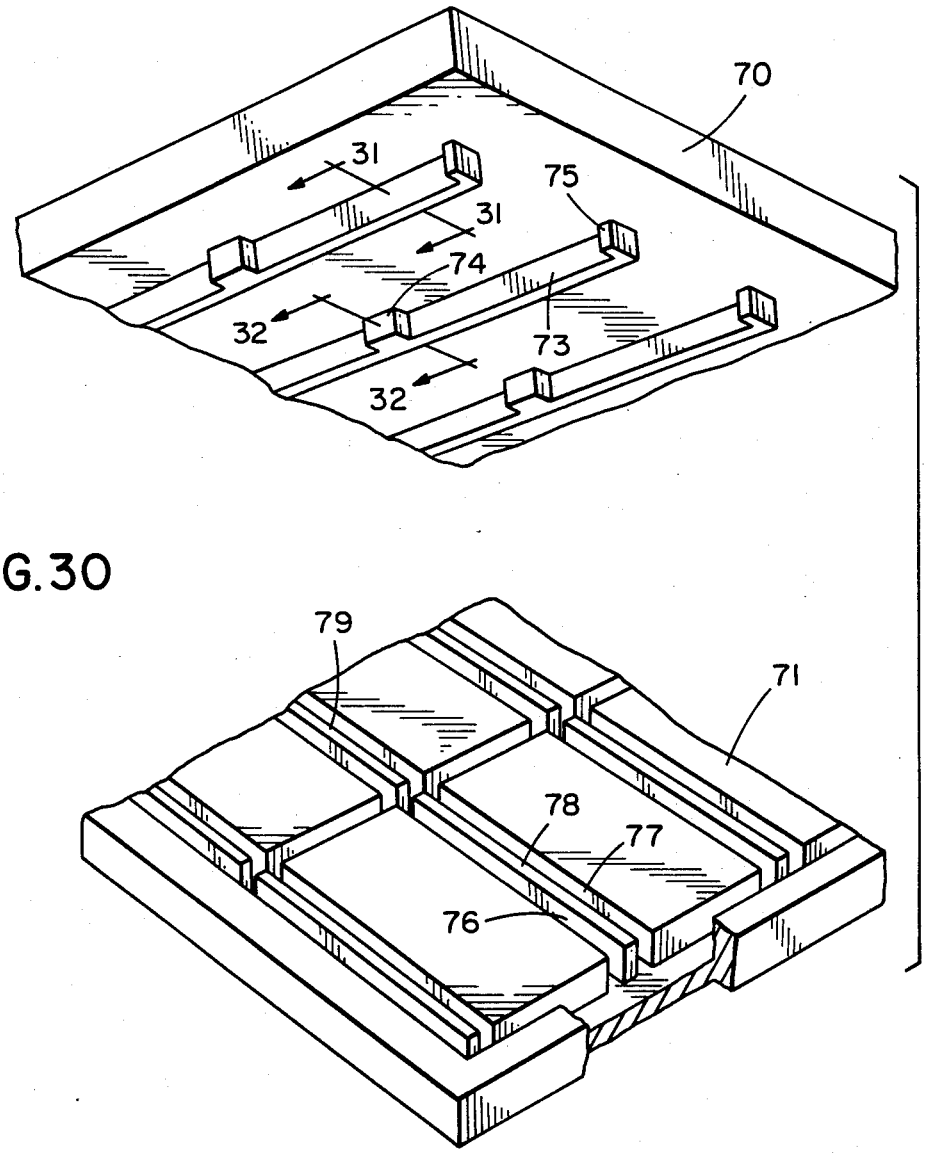
FIG. 30 is an exploded fragmentary perspective of a simplified exemplary mold for forming the slots in the top and bottom panels.
Figure 31:
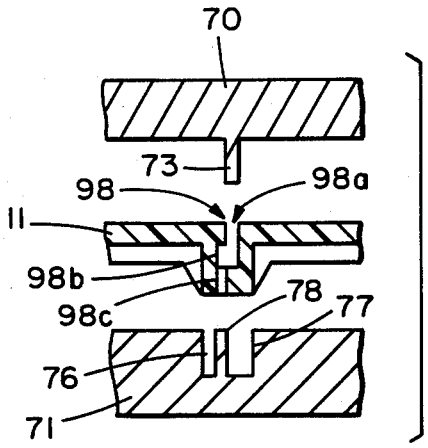
FIG. 31 is a fragmentary exploded section of the mold taken generally along line 31—31 of FIG. 30 with a portion of the top panel taken generally along line 31—31 of FIG. 12.
Figure 32:
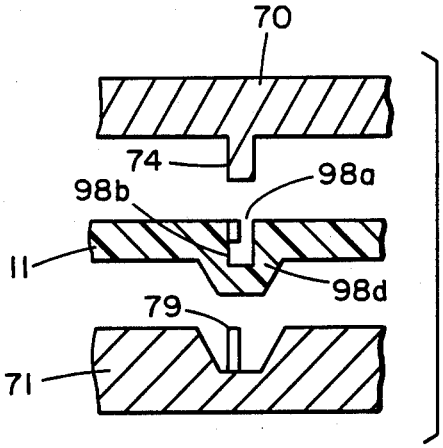
FIG. 32 is a fragmentary exploded view similar to FIG. 31 taken generally through line 32—32 of FIG. 30 and line 32—32 of FIG. 12.

An important aspect of the present invention is that the slots 52 in the top panel 12 and slots 98 in the bottom panel are formed by rigid mold portions on both the top and bottom plates of the mold for the panel 12 without the use of any transverse or movable core members and exemplary top and bottom plates are illustrated at 70 and 71 in FIGS. 30, 31 and 32. It should be understood that the top and bottom plates 70 and 71 are diagramatic only and illustrate just the mold portions necessary to mold the slots 52 on the panel 12 and not the connecting barbs or tongues. It should be noted that while slots 52 and 98 have the same shape, the mold plates 70 and 71 are for the bottom panel 11 and that the slot forming elements for the top panel would be reversed in the mold plates.

Figure 20:
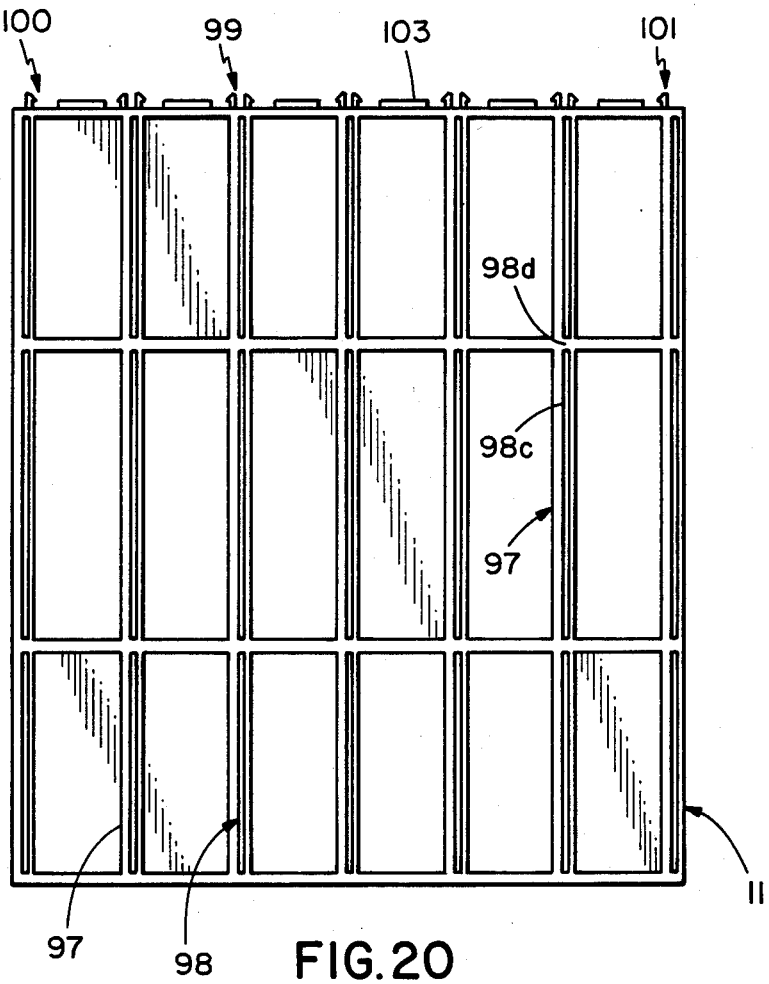
FIG. 20 is a rear view of the bottom panel illustrated in FIGS. 18 and 19.

As seen in FIG. 30 and 31 the top plate has a plurality of parallel longitudinal ribs 73 that form slot portion 98*a* and a plurality of transverse projections 74 and 75 from the ribs that define the portions 102 of the slots 98 at the web portions 98*d*. The bottom plate 71 includes recesses 76 and 77 separated by spaced longitudinal ribs 78 and 79 that form slots 98*c* in the rear of the panel 11 as seen in FIG. 20 with the spacing between the ribs 78 and 79 defining web portions 98*d*, for example, as seen clearly in FIG. 32. In this way the L-shaped slots 98 are formed solely by the rigid configuration of the top and bottom plates 70 and 71 without the need for any movable core elements.

Figure 8:
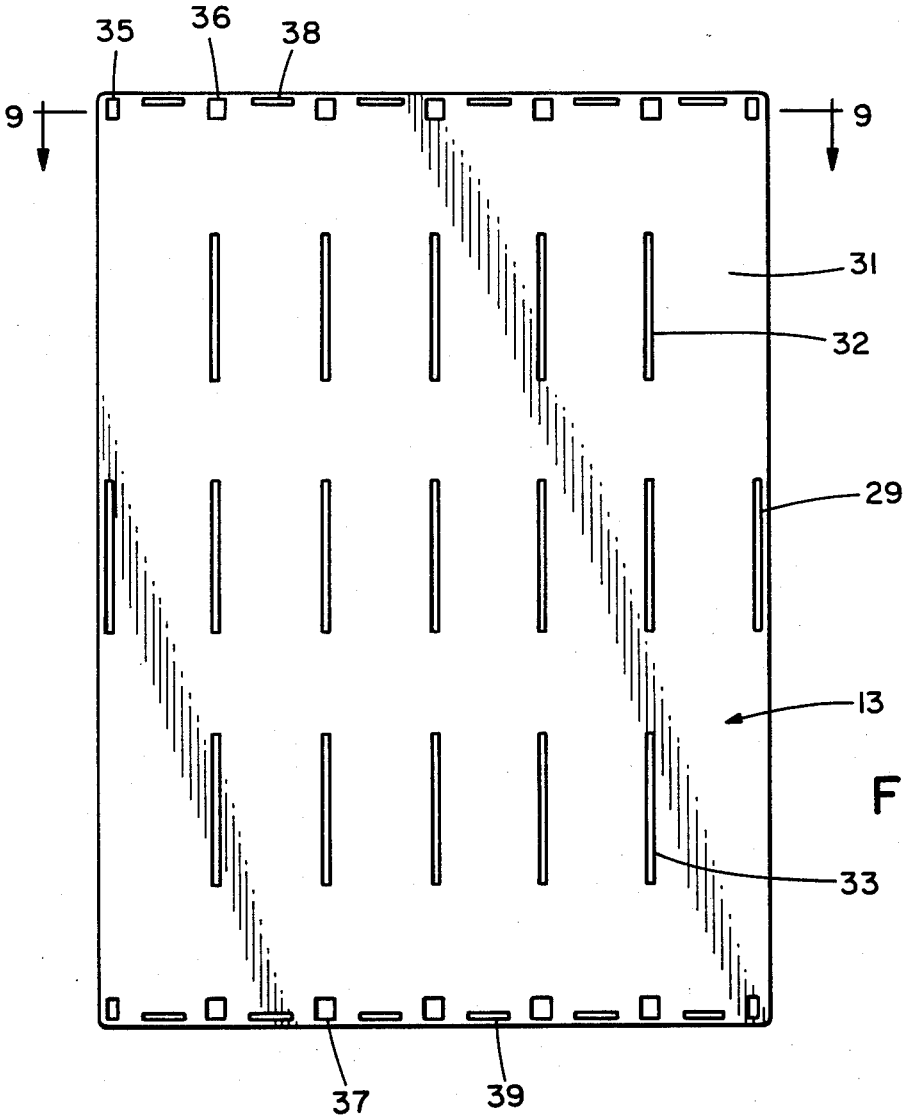
FIG. 8 is a front view of the rear panel illustrated in FIG. 1.
Figure 9:
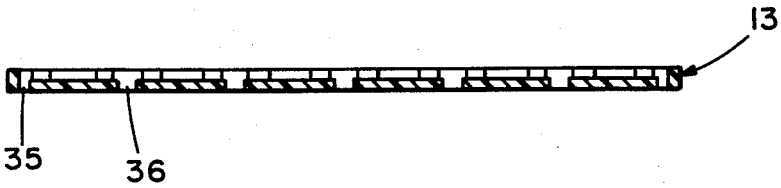
FIG. 9 is a cross-section of the rear panel taken generally along line 9—9 of FIG. 8.
Figure 23:
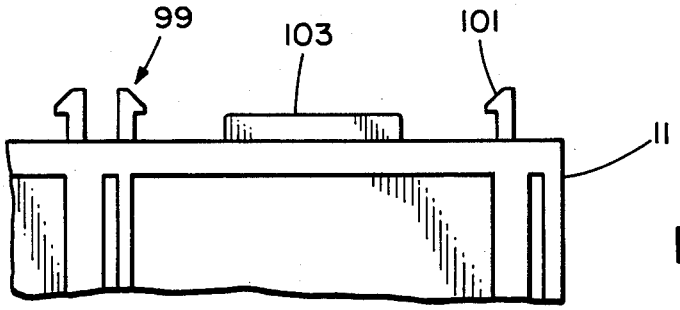
FIG. 23 is an enlarged fragmentary rear view of the bottom panel illustrated in FIGS. 18 and 20.
Figure 24:
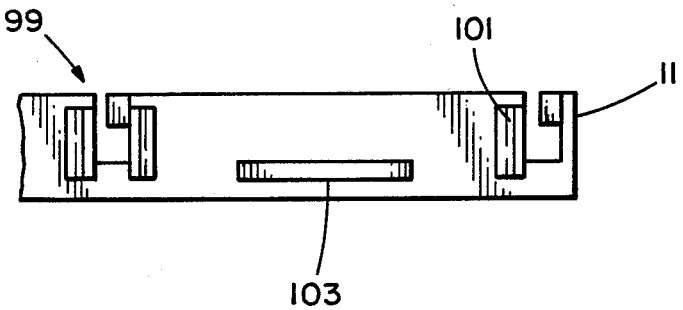
FIG. 24 is an enlarged fragmentary top view of the bottom panel as shown in FIG. 23.
Figure 25:
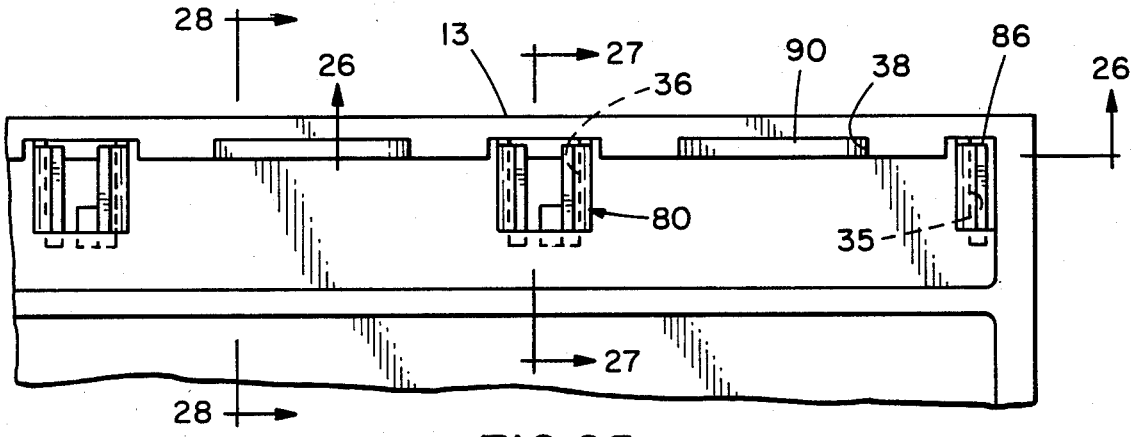
FIG. 25 is a fragmentary rear view of the entire assembly illustrated in FIG. 1 showing a portion of the top panel connected to a portion of the rear panel.

As seen in the enlarged views of FIGS. 23 and 24 of the bottom panel 11, integral tongue projections 103 extend between each of the barb sets 99 and the barbs 100 and 101 that interfit in the lower slots 39 in the rear panel illustrated in FIG. 8, and the barb sets 99, 100 and 101 snap into the rectangular recesses 37 in the lower portion of the rear panel 13.

In assembly, the user places the rear panel 13 on a horizontal surface with the forward wall 31 facing upwardly, and positions the top panel 12 vertically with the barbs 81, 82 and 86 entering slots 36 or 37 and firmly hand taps the top panel until the barbs and tongues 90 enter and lock in the rear panel 13. The bottom panel 11 is then locked to the rear in the same way. Thereafter the resulting assembly is placed in an upright position with the bottom panel 11 on a horizontal surface and the side panels 14, 15 and the partition panel 16 are slid into the slots 52 and 98 in the top and bottom panels respectively and pushed rearwardly toward the rear panel 13 until the barbs 25 and 26 and tongues 27 fit into and snap into the central slots 29 in the rear panel 13, locking these members together. The result is a rigid and durable assembly. The partitions 16 may be positioned in any one of the slots as desired to accommodate the particular book sizes desired.

I claim:

1. A generally rectangular panel plastic container wherein the panels are molded separately and thereafter assembled together without the use of any tools, and wherein the container may be constructed to be positioned in a variety of orientations, comprising: first and second opposed parallel panels interconnected at one end by a third panel, first manually activated integral snap-locking devices interconnecting the first and third panels and the second and third panels, at least two integral parallel locking slots integrally formed in the first and second panels with the slots in the first panel being aligned with the slots in the second panel, fourth and fifth panels slidably positioned in the aligned slots in the first and second panels and having locking slides slidable in the locking slots, and manually activated integral snap-locking devices interconnecting the fourth and third panels and the fifth and third panels.

2. A generally rectangular panel plastic container as defined in claim 1, wherein at least some of the manually activated integral snap-locking devices include a plurality of rectangular apertures in the third panel, and a plurality of integral flexible barbs on the first and second panels that snap into the rectangular apertures in the third panel.

3. A generally rectangular panel plastic container as defined in claim 2, wherein said first and second panels have rigid shoulders on the sides of the barbs orthogonally positioned with respect to the direction of flexibility thereof that engage the side of the third panel into which the barbs are inserted to stabilize the first and second panels on the third panel.

4. A generally rectangular panel plastic container as defined in claim 1, wherein the locking slots in the first and second panels have an "L" shaped cross section and the locking slides on the fourth and fifth panel have a cooperating "L" shaped projection slidable in the "L" shaped locking slots.

5. A generally rectangular panel plastic container as defined in claim 1, wherein the locking slots are formed by a first slot extending only part way through one panel from one side thereof, a second slot laterally offset from but connecting with the first slot extending only part way through the one panel from the other side thereof, said second slot having spaced bridge portions intercepting the second slot to provide rigidity to the one panel, and a plurality of third slots extending only part way through the one panel from said one side aligned with the second slot and positioned only over the bridge portions to complete the "L" shaped configuration of the locking slots.

6. A generally rectangular panel plastic container wherein the panels are molded separately and thereafter assembled together without the use of any tools, and wherein the container may be constructed to be positioned in a variety of orientations, comprising: first and second opposed parallel panels interconnected at one end by a third panel, and fourth and fifth opposed panels each attached to and orthogonally related to the first, second and third panels, said third panel having a plurality of small rectangular apertures extending along the edges thereof adjacent the first and second panels, said first and second panels having a plurality of sets of two flexible barbs integrally molded thereon with each set being insertable into one of the rectangular apertures in the third panel, each set of barbs having a width greater than the width of the apertures so that they snap into the apertures.

7. A generally rectangular panel plastic container as defined in claim 6, including a tongue on the first and second panels between each set of barbs insertable into complementary slots in the third panel to stabilize the first and second panels on the third panel.

8. A generally rectangular panel plastic container as defined in claim 6, wherein said first and second panels have rigid shoulders on the sides of the barbs orthogonally positioned with respect to the direction of flexibility thereof that engage the side of the third panel into which the barbs are inserted to stabilize the first and second panels on the third panel.

9. A generally rectangular panel plastic container as defined in claim 6, wherein said first and second panels have a plurality of parallel ribs therein with slots thereon, said fourth and fifth panels having slides along the opposite edges thereof slidable in the slots to hold the fourth and fifth panels to the first and second panels, said barbs being integral extensions of the ribs to simplify mold manufacture and molding.

10. A generally rectangular panel plastic container wherein the panels are molded separately and thereafter assembled together without the use of any tools, and wherein the container may be constructed to be positioned in a variety of orientations, comprising: first and second opposed parallel panels interconnected at one end by a third panel, at least two integral parallel locking slots integrally formed in the first and second panels with the slots in the first panel being aligned with the slots in the second panel, fourth and fifth panels slidably positioned in the aligned slots in the first and second panels and having locking slides slidable in the locking slots, the locking slots being formed by a first slot extending only part way through one panel from one side thereof, a second slot laterally offset from but connecting with the first slot extending only part way through the one panel from the other side thereof, said second slot having spaced bridge portions intercepting the second slot to provide rigidity to the one panel, and a plurality of third slots extending only part way through the one panel from said one side aligned with the second slot and positioned only over the bridge portions to complete the "L" shaped configuration of the locking slots.

11. A generally rectangular panel plastic container wherein the panels are molded separately and thereafter assembled together without the use of any tools, and wherein the container may be constructed to be positioned in a variety of orientations, comprising: first and second opposed parallel panels interconnected at one end by a third panel, first manually activated integral snap-locking devices interconnecting the first and third panels and the second and third panels, at least two integral parallel locking slots integrally formed in the first and second panels with the slots in the first panel being aligned with the slots in the second panel, fourth and fifth panels slidably positioned in the aligned slots in the first and second panels and having locking slides slidable in the locking slots, manually activated integral snap-locking devices including flexible barbs interconnecting the fourth and third panels and the fifth and third panels, said first and second panels having rigid shoulders on the sides of the barbs orthogonally positioned with respect to the direction of flexibility thereof that engage the side of the third panel into which the barbs are inserted to stabilize the first and second panels on the third panel, the locking slots being formed by a first slot extending only part way through one panel from one side thereof, a second slot laterally offset from but connecting with the first slot extending only part way through the one panel from the other side thereof, said second slot having spaced bridge portions intercepting the second slot to provide rigidity to the one panel, and a plurality of third slots extending only part way through the one panel from said one side aligned with the second slot and positioned only over the bridge portions to complete the "L" shaped configuration of the locking slots.

* * * * *